US005255602A

United States Patent [19]

Mamberer et al.

[11] Patent Number: 5,255,602

[45] Date of Patent: Oct. 26, 1993

[54] APPARATUS FOR THREADING WEBS IN ROTARY PRINTING MACHINES

[75] Inventors: Hans Mamberer, Königsbrunn; Johann Winterholler, Friedberg, both of Fed. Rep. of Germany

[73] Assignee: MAN Roland Druckmaschinen AG, Offenbach am Main, Fed. Rep. of Germany

[21] Appl. No.: 941,399

[22] Filed: Sep. 8, 1992

[30] Foreign Application Priority Data

Sep. 14, 1991 [DE] Fed. Rep. of Germany ..... 4130678

[51] Int. Cl.[5] ..... B41F 13/02

[52] U.S. Cl. ..... 101/228; 226/92

[58] Field of Search ..... 101/228, 219, 181, 227, 101/224, 225, 178, 176, 138; 226/91, 92, 96, 109; 242/56.2, 195, 74, 55; 198/844.1, 846

[56] References Cited

U.S. PATENT DOCUMENTS

| | | | |
|---|---|---|---|
| 2,944,345 | 7/1960 | Faeber | 226/92 X |
| 3,125,335 | 3/1964 | Becker . | |
| 4,063,505 | 12/1977 | Sasamoto et al. . | |
| 4,370,927 | 2/1983 | Fischer | 101/228 |
| 4,973,040 | 11/1990 | Kemp | 101/232 |
| 5,152,471 | 10/1992 | Goerner | 226/92 X |

FOREIGN PATENT DOCUMENTS

| | | |
|---|---|---|
| 0355026A3 | 2/1990 | European Pat. Off. . |
| 0418903A2 | 3/1991 | European Pat. Off. . |
| 3312038 | 12/1983 | Fed. Rep. of Germany . |

*Primary Examiner*—J. Reed Fisher

*Attorney, Agent, or Firm*—Frishauf, Holtz, Goodman & Woodward

[57] ABSTRACT

An apparatus for threading webs in rotary printing machines. A threading belt (13) in the form of a hook band of a "VELCRO" closure is guided on the threading path, and the leading edge of the web has a loop band (35) which is engaged in the threading belt.

9 Claims, 4 Drawing Sheets

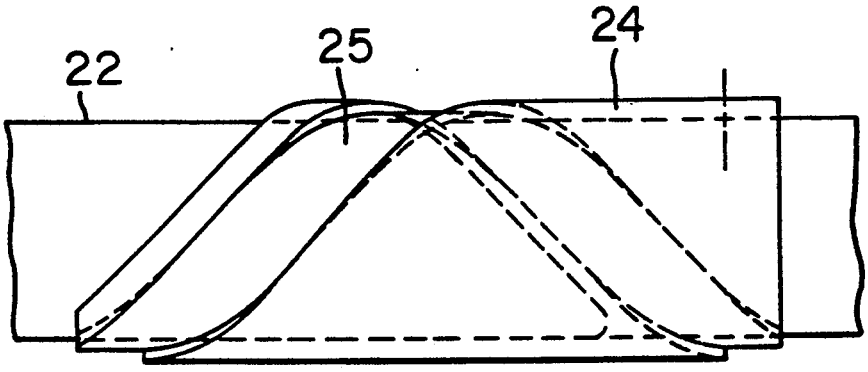
FIG. 5
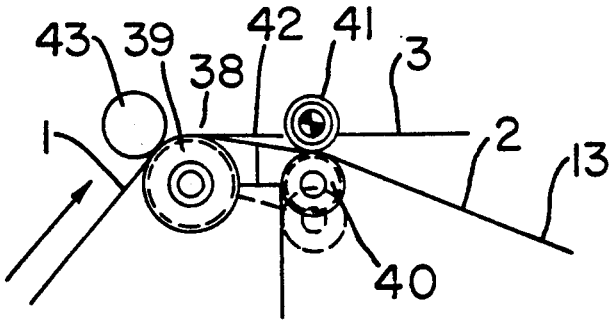
FIG. 6
FIG. 7
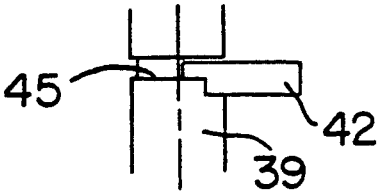

APPARATUS FOR THREADING WEBS IN ROTARY PRINTING MACHINES

FIELD OF THE INVENTION

The invention relates to an apparatus for threading webs in rotary printing machines with an endless belt system which is guided on the threading path along which the web to be threaded travels and, in particular, to an arrangement for engaging the endless belt with the web for carrying out a threading operation.

BACKGROUND

U.S Pat. No. 4,063,505 discloses a threading apparatus with an endless belt used in a rotary printing press. The endless belt system includes an upper and a lower belt, and the web to be threaded is nipped between the two. The upper and lower belts are pressed together by rollers and are aligned with each other by mechanically inter-engaging parts thereof or magnetically. A partial web produced after lengthwise cutting can be threaded via turning bars.

This apparatus is costly because of the need for two belts. Devices to guide the two belts add to the expense. This guidance apparatus must be located outside of the area of the web. The turning bars have expensive rollers in this area. Also, in addition to the one lengthwise cutting apparatus normally used, a second one is necessary which initially cuts the partial web to be threaded to a wider width for the length of the threading section so that the partial web can reach the threading belts outside of the web area.

THE INVENTION

It is an object of the invention to provide an apparatus having an endless belt system for threading webs in rotary printing machines which is guided on the threading path along which the web to be threaded is moved, and which can be produced at reasonable cost. In addition, threading of a partial web by means of turning bars is also to be made possible with minimal effort.

Briefly, this object is attained in accordance with one aspect of the invention in that a threading belt, in the form of the hook band of "VELCRO" (trademark) closure, is guided on the threading path, and that the beginning of the web has the loop side of a VELCRO closure, or vice versa. The apparatus operates with just one threading belt and does not require a second lengthwise cutting apparatus. The leading edge of the web is advantageously reinforced by the loop band glued on the under-surface thereof.

The invention is described below in detail by means of exemplary embodiments shown in the associated drawings.

DRAWINGS

FIG. 5 is an expanded view of area V of FIG. 2, shown without the threading belt; and FIG. 6 is another embodiment of the invention, and corresponds to a side view of FIG. 3.

FIG. 7 is a partial plan view of the arrangement shown in FIG. 6.

DETAILED DESCRIPTION

Figure 1:
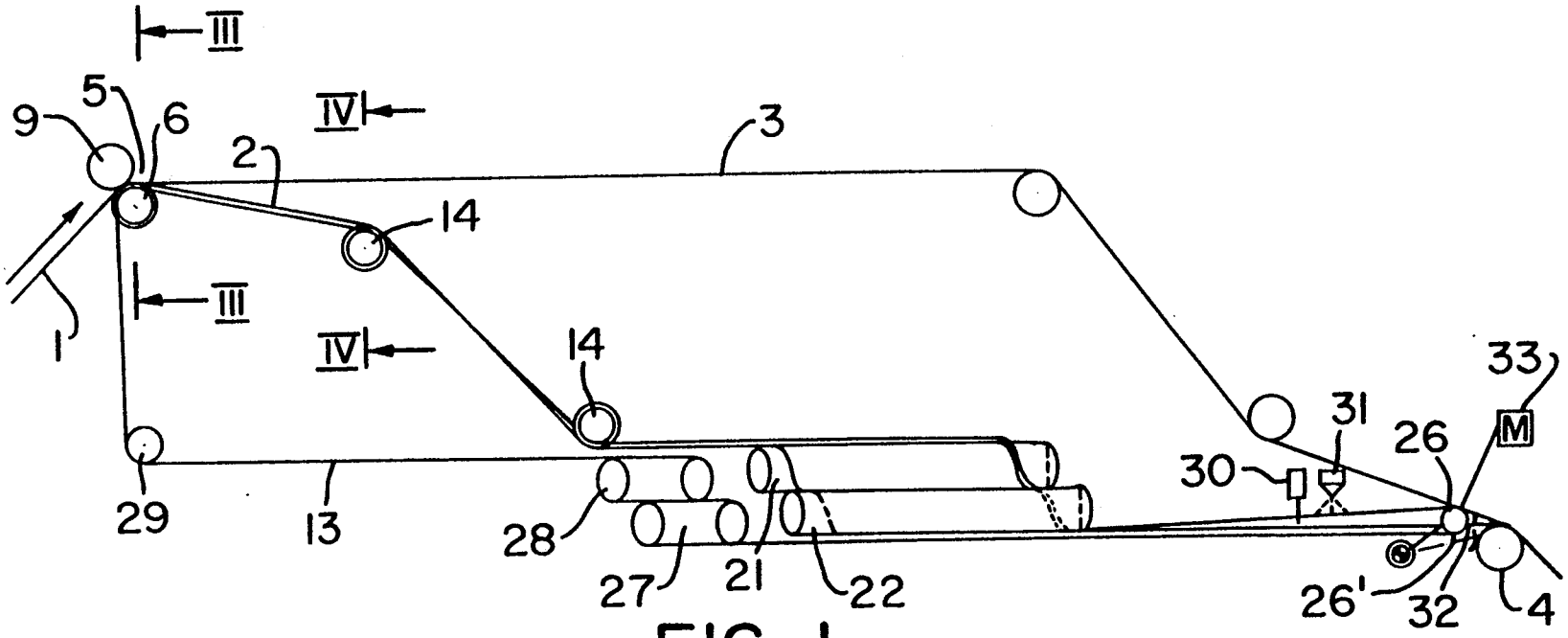
FIG. 1 is an elevational view of a threading apparatus.
Figure 3:
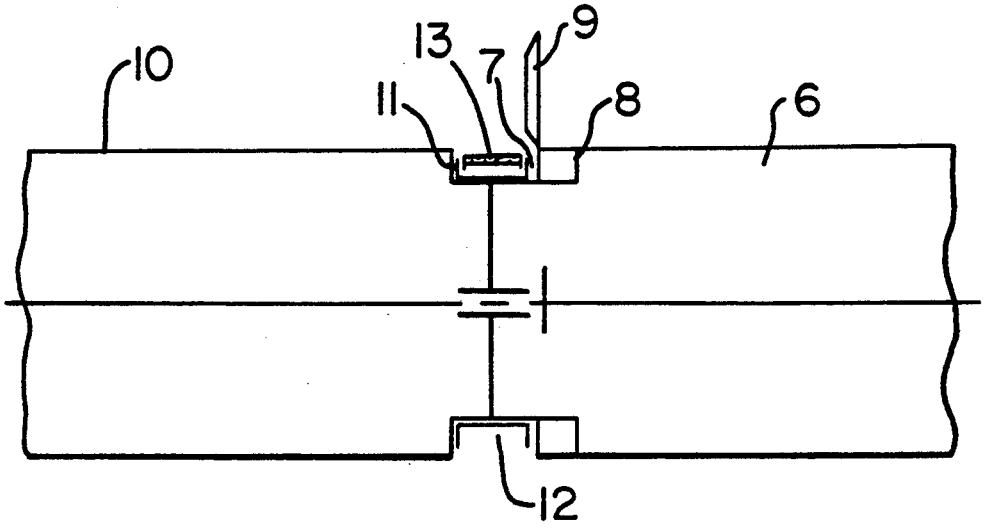
FIG. 3 is a view taken along line III—III of FIG. 1.

FIG. 1 shows the area of a printing machine which can be found between printing systems, not shown, and a folding apparatus, also not shown. A printed web 1 is cut lengthwise here and the partial webs 2, 3 are transported, lying on top of each other, to the folding apparatus (not shown) via the feed roller 4. As shown in FIG. 3, lengthwise cutting apparatus 5 contains a cutting roller 6 which supports a cutting ring 8 in a cutting groove 7. The cutting ring 8 cooperates with a cutter 9. A roller 11, which receives the threading belt 13 in a groove 12, is rotatably accommodated in the cutting groove 7 adjacent the roller sleeve 10. The radius of threading belt 13 is somewhat less than the radius of roller sleeve 10. Therefore, the threading belt 13 is located slightly lower than the surface of the roller sleeve 10 so that the threading belt 13, which is stopped following the threading process, does not scrape on the web surface.

Figure 4:
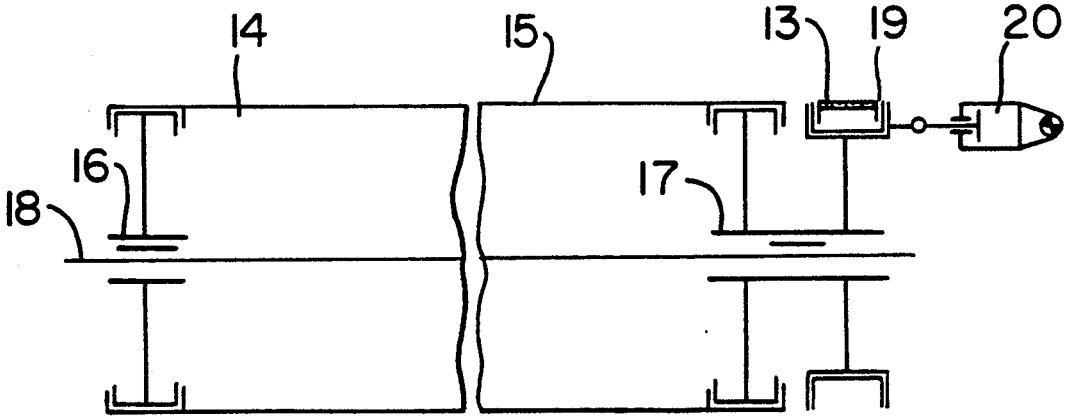
FIG. 4 is a guide roller in accordance with a view taken along line IV—IV of FIG. 1.

Further along the threading path the threading belt is conducted over paper guide rollers 14. As shown in FIG. 4, the roller sleeve 15 of a roller 14 is rotatably seated on bushings 16, 17 which, in turn, are slidably disposed on the guide roller shaft 18. The bushing 17 supports a roller 19 in addition to the roller sleeve 15. Roller 19 is rotatable in respect to the latter and receives the threading belt 13. Furthermore, a working cylinder 20 which is seated in the frame is hinged on the bushing 17. In place of this a magnet could also be used as a motor.

Figure 2:
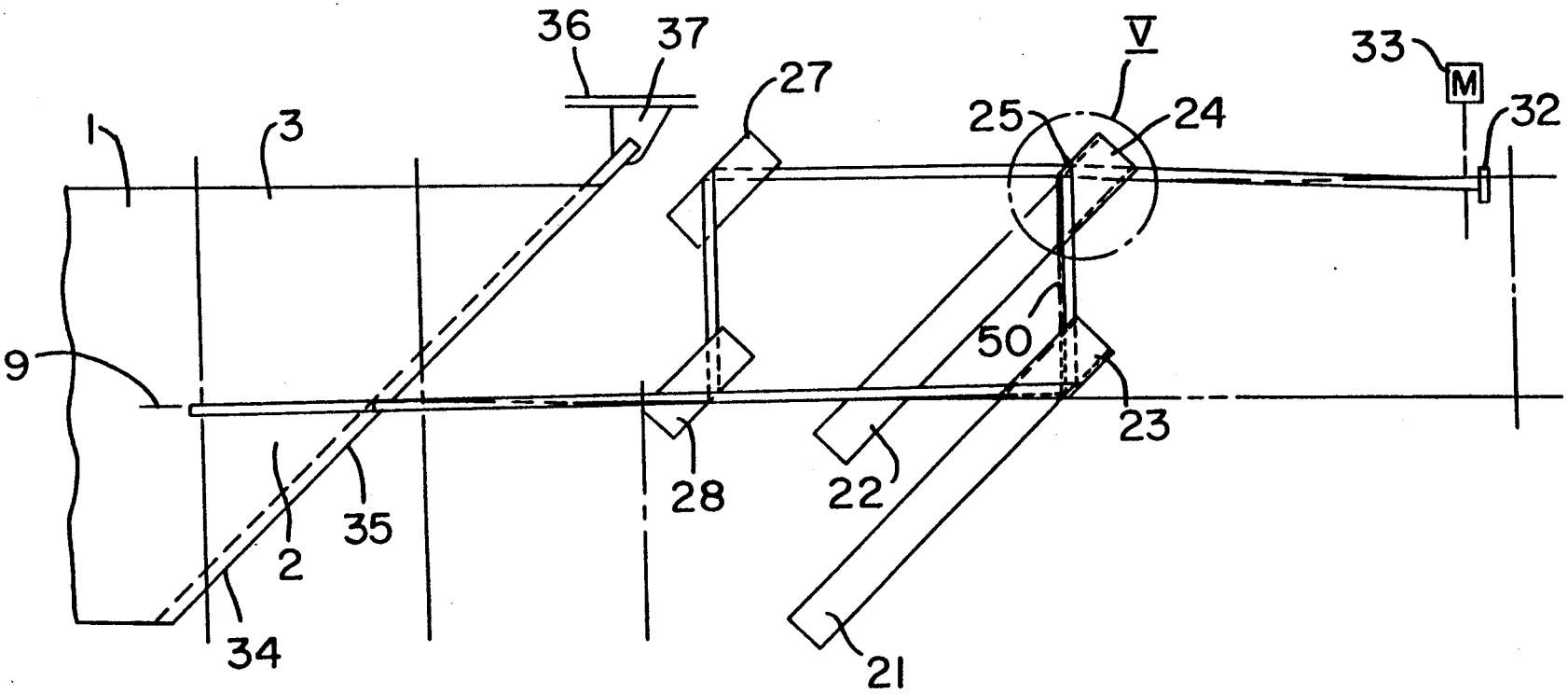
FIG. 2 is a top view of the threading path of FIG. 1.

Then, the threading belt 13 passes over the turning bars 21, 22. For this purpose they each include a web guide region having a spiral bushing 23, 24 outside the area where the belt is led (FIG. 2). Each spiral bushing 23, 24 has a spiral groove 25, in which the threading belt 13 is conducted (FIG. 5). If the spiral bushings 23, 24 are omitted, the spiral groove can also be cut directly into the sleeves of the turning bars 21, 22. The end of the web guide region is depicted by dot-dash line 50 shown in FIG. 2.

The threading belt 13 is then guided to a reversing roller 26 and from there, via turning bars 27, 28 and a belt roller 29 back to the cutting roller 6. A sensor 30 and a spray nozzle 31 are disposed in the area of the reversing roller 26, and a stripper 32 is located on the reversing roller 26. The reversing roller 26 is pivotable and is in driven connection with a motor 33. The turning bars 27, 28 have spiral grooves in which threading belt 13 is conducted.

The web 1 which is to be threaded is provided with a tip 34 (see FIG. 2), on the underside of which a "VELCRO" loop band 35 is glued. The web 1 is threaded through the printing machine by means of a threading apparatus such as, for example, a chain 36 with a pusher 37. When passing the cutting roller 6, the web 1 is cut lengthwise. While the partial web 3 thus created continues to be threaded by the chain 36 along the path shown in FIG. 2, the "VELCRO" loop band 35 of the partial web 2 comes into engaged contact with "VELCRO" hooks on the threading belt 13. This occurs automatically in the course of web 2 passing the cutting roller 6 because of the tensile force components on web 1 as it wraps around the cutting roller 6 and, thus, partial web 2 is pulled toward threading belt 13 guided around roller 6. The gap between partial web 2 wound around sleeve 10 and threading belt 13 located below the surface thereof is bridged by the bulkiness of loop band 35 so that its loops are firmly grasped by the hooks of belt 13. However, once loop band 35 passes, the gap is wide enough to avoid scraping of partial web 2 on threading belt 13.

During the threading process, threading belt 13 is driven by the motor 33 (see FIGS. 1 and 2) at threading speed. First it pulls the partial web 2 over the guide rollers 14. These rollers 14 are axially positioned by means of the working cylinders 20 in such a way that its rollers 19 guiding the threading belt 13 are located in the path of the threading belt 13 which exits from the web guidance area. Then the partial web 2 is threaded via the turning bars 21, 22 to the reversing roller 26. The latter takes up the illustrated position during threading. The arrival of the partial web 2 is signaled by the sensor 30, whereupon by means of the spray nozzle 31 glue is sprayed on the beginning of the web and the latter adheres to the underside of the partial web 3 when passing the reversing roller 26. Next, the partial web 2 is pulled off the threading belt 13 by means of the stripper 32.

With the threading process completed, the motor 33 is shut off and the reversing roller 26 is pivoted into the position 26' indicated by dashed lines. In addition, the working cylinders 20 are reversed and by means of this the roller sleeves of the paper guide rollers 14 are axially displaced, because of which the rollers 19 together with the threading belt 13 are moved out of the web guidance area. Due to the displaceability of threading belt 13 in this manner, the structural lowering of the threading belt 13 below the surface of rollers 14 can be omitted. During operation of the printing machine, the partial web 2 is continuously supported over its entire width on the roller sleeves 15.

A variant of the guidance of the threading belt 13 in the area of a lengthwise cutting device is illustrated in FIGS. 6 and 7. A belt roller 40, which can be pivoted against a pressure roller 41, is disposed downstream of the paper guide roller embodied as a cutting roller 39. Threading belt 13 is wound around belt roller 40. A guiding tongue 42 extends into a groove 45 of the roller 39, and is located between the cutting roller 39 and the belt roller 40. During threading of the paper, the belt roller 40 is placed against the pressure roller 41. The web 1, led over the cutting roller 39, is cut lengthwise by means of a cutter 43 into partial webs 2 and 3. In the course of further threading of the partial web 3 (in a manner analogous to that discussed above with respect to FIG. 2), the beginning of partial web 2 is lifted from cutting roller 39 and is guided with the cooperation of the guide tongue 42 between the belt roller 40 and the pressure roller 41. Because of the effect of the force between these two rollers, the threading belt 13, embodied as a "VELCRO" hook band, comes into engaged contact with a Velcro loop band glued underneath the leading edge of the partial web 2. Further threading takes place as in the above-described first embodiment. After threading, the belt roller 40 is returned to position 40' shown by dashed lines where it is displaced from being in contact with pressure roller 41. Because of this, during the printing operation the threading belt 13 is not located in the path of the partial web 2.

In the exemplary embodiment, the leading edge of the web was provided with a loop band and the threading belt was embodied as a hook band of a "VELCRO" closure. Also encompassed within this invention is the reverse arrangement in which a hook band is glued under the leading edge of the web and the threading belt can be embodied as a loop band. Also, the threading belt can be guided around other turning bar arrangements.

Various other such modifications will readily occur to one ordinarily skilled in the art, and all such modifications are intended to fall within the scope of the present invention as defined by the following claims.

We claim:

1. An apparatus for threading webs in rotary printing machines with a belt system which is guided on a threading path along which a web is to be threaded, comprising:

a threading belt (13) in the form of one of a loop band and a hook band made of a "VELCRO" closure;

means for guiding said threading belt along the threading path;

a band comprising the other of the loop and hook bands of a "VELCRO" closure secured at a leading edge of the web; and means for directing said band into automatic engagement with said threading belt to initiate threading of said web with said threading belt.

2. An apparatus in accordance with claim 1, further comprising a lengthwise cutting apparatus (5, 38), turning bars (21, 22), a reversing roller (26) and turning devices, and wherein the web (1) is cut lengthwise into two partial webs (2, 3), said threading belt being coupled to one of said partial webs (2), and wherein said guiding means guides the threading belt (13) from an area of said lengthwise cutting apparatus (5, 38) via said turning bars (21, 22) to the other partial web (3) and back via said reversing roller (26) and said turning devices.

3. An apparatus in accordance with claim 2, wherein said guiding means comprises a roller sleeve (10) and a cutting roller (6) having a cutting groove (7), and said threading belt being guided next to said cutting groove within a groove (12) of a roller (11) which rotatably seated in said roller sleeve (10), the radius of said threading belt within said groove (12) being smaller than the radius of a guide roller surface of said roller sleeve (10) on which said one partial web is supported such that said threading belt is located lower than said guide roller surface to be spaced from said one partial web.

4. An apparatus in accordance with claim 2, wherein said guide means comprises a belt roller (40) and a guide tongue (42) disposed downstream of a lengthwise cutting apparatus (38), said guide tongue (42) guiding said threading belt (13) to travel over said belt roller (40), said belt roller being pivotable against a pressure roller (41).

5. An apparatus in accordance with claim 2, wherein the threading belt (13) is guided on each of the turning bars (21, 22) in a spiral groove which is disposed next to a web guidance area of the turning bar (21, 22).

6. An apparatus in accordance with claim 5, wherein on each of said turning bars (21, 22) a spiral bushing (23, 24) is disposed next to the web guidance area, said spiral bushing supporting a spiral groove (25) which receives the threading belt (13).

7. An apparatus in accordance with claim 2, wherein said guiding means comprises paper guide rollers (14) disposed on the threading path and each having a roller sleeve (15) which is rotatably seated on bushings (16, 17) disposed, in turn, at ends of a guide roller shaft (18), one of said bushings (17) at one end of the roller sleeve (15) having a roller (19) which rotatably receives the threading belt (13), and motive means to move said one bushing (17) axially along said guide roller shaft.

8. An apparatus in accordance with claim 2, wherein said reversing roller (26) is pivotally mounted so that it can be pivoted against the other of said partial webs (3), further comprising a sensor (30) and a spray nozzle (31) disposed upstream of the reversing roller (26), and a stripper (32) downstream of the reversing roller (26).

9. An apparatus in accordance with claim 2, wherein the reversing roller (26) is driven by a motor (33).

* * * * *